United States Patent [19]

Raasch

[11] 4,002,306

[45] Jan. 11, 1977

[54] METHOD AND APPARATUS FOR WINDING CONICAL CROSS-WOUND COILS OR BOBBINS WITH CONSTANT THREAD-FEEDING VELOCITY

[75] Inventor: Hans Raasch, Monchengladbach, Germany

[73] Assignee: W. Schlafhorst & Co., Monchen-Gladbach, Germany

[22] Filed: Nov. 20, 1975

[21] Appl. No.: 633,706

[30] Foreign Application Priority Data

Nov. 20, 1974 Germany ..... 2454916

[52] U.S. Cl. ..... 242/18 R; 242/18 DD; 242/43 R; 242/45

[51] Int. Cl.[2] ..... B65H 54/02

[58] Field of Search ..... 242/18 R, 18 DD, 18 CS, 242/43, 45

[56] References Cited

UNITED STATES PATENTS

| | | | |
|---|---|---|---|
| 2,524,623 | 10/1950 | Colombu | 242/43 UX |
| 2,618,441 | 11/1952 | Marcellus | 242/45 |
| 2,950,068 | 8/1960 | Rutgers | 242/43 |
| 3,359,715 | 12/1967 | Mackie | 242/43 X |
| 3,633,836 | 1/1972 | Haag | 242/43 |
| 3,640,477 | 2/1972 | Furst | 242/18 R |
| 3,690,576 | 9/1972 | Schroeder | 242/18 DD |
| 3,908,920 | 9/1975 | Hermanns | 242/45 |

*Primary Examiner*—John Petrakes
*Attorney, Agent, or Firm*—Herbert L. Lerner

[57] ABSTRACT

Method of winding conical cross-wound coils at constant thread feed velocity wherein compensation is provided by a storage device for the varying winding speeds from the larger to the smaller diameters of the coils which includes setting a thread storage device in zero position thereof, wherein no thread is being stored, after alternative occurrence of a coil change and a thread break; initially holding with an auxiliary thread guide a thread that is to be wound into a coil; advancing a thread guiding member in a direction from the larger toward the smaller diameter ends of the coil and, after releasing the thread from the auxiliary thread guide, taking over the thread with the thread guiding member.

7 Claims, 1 Drawing Figure

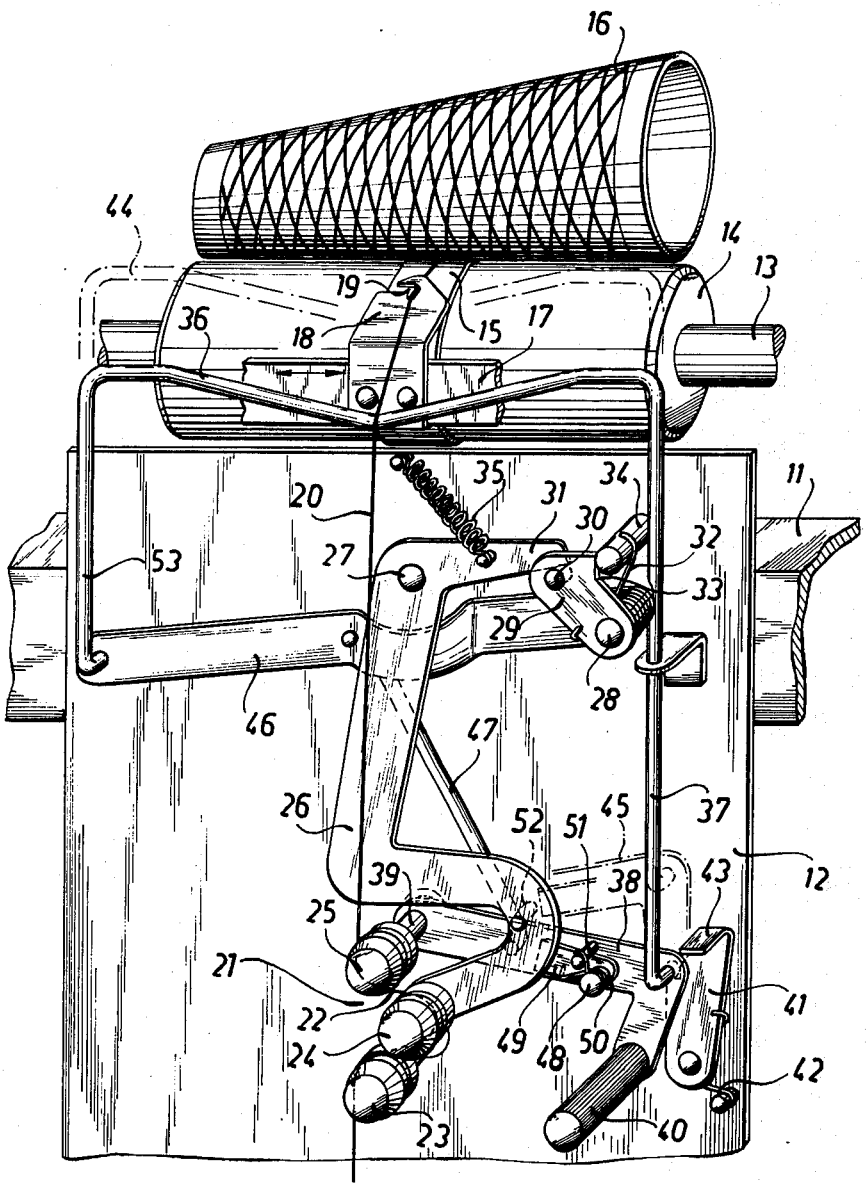
16
44
14
13
19
15
17
36
18
35
34
11
20
31
30
32
53
27
33
29
28
46
47
26
52
51
45
37
12
39
38
43
25
21
41
22
49
48
50
24
42
23
40

METHOD AND APPARATUS FOR WINDING CONICAL CROSS-WOUND COILS OR BOBBINS WITH CONSTANT THREAD-FEEDING VELOCITY

The invention relates to a method and apparatus for winding conical cross-wound coils or bobbins with constant thread-feeding velocity.

When a conical cross-wound bobbin is driven with constant peripheral velocity in a textile machine, variations in the instantaneous winding speed occur in the course of winding this coil, because the thread is wound at the narrow or wide end of the bobbin or in the middle of the bobbin, depending upon the position of the thread guiding member.

The varying winding velocity must be equalized or compensated for, when the thread is fed at constant velocity, as is the case, for example, in spinning frames.

For this purpose, it has been proposed heretofore to dispose a thread storage device between the winding device and the threadfeeding mechanism. Such a thread storage device is formed, for example, of a spring- or weight-loaded compensating roller, which produces a thread loop of continuously changing length which meets the requirements of the winding process.

In starting up such a winding apparatus, difficulties are encountered, because at the instant of starting, the length of the stored thread is undetermined. The stored thread will only purely accidentally have a length corresponding to the position of the thread guiding member. In all other cases, the length of the stored thread is either too great or too small. Both are disadvantageous. When the stored length is too small, excessive thread tension occurs during start-up, which may result in a thread break.

When the stored length is too great, there is either no thread tension at all, or not enough of it. Disruptions due to uncontrolled thread movements result especially therefrom. The thread can loop around the thread guide and consequently break.

It is accordingly an object of the invention to provide a method and apparatus for winding cross-wound coils or bobbins with constant thread-feeding velocity which avoids the foregoing disadvantages of the heretofore known methods and apparatus of this general type. More specifically, it is an object of the invention to provide such a method and apparatus which will ensure that a winding device for conical cross-wound bobbins will operate with substantially constant thread tension from the very first instant of start-up, so that disruptions due to excessive or insufficient thread tension or due to no thread tension at all, are avoided.

With the foregoing and other objects in view, there is provided in accordance with the invention, a method of winding conical cross-wound coils at constant thread feed velocity wherein compensation is provided by a storage device for the varying winding speeds from the larger to the smaller diameters of the coils which includes setting a thread storage device in zero position thereof, wherein no thread is being stored, after alternative occurrence of a coil change and a thread break; initially holding with an auxiliary thread guide a thread that is to be wound into a coil; and advancing a thread guiding member in a direction from the larger toward the smaller diameter ends of the coil and, after releasing the thread from the auxiliary thread guide, taking over the thread with the thread guiding member.

The zero position or neutral setting of the thread storage device is defined as that position in which the available stored thread content has just become zero so that upon start-up the storing process begins anew.

In accordance with another feature of the invention, the method includes rotating the coil and wherein the thread is held by the auxiliary thread guide at a location along the length of the coil at which the peripheral velocity of the coil is substantially equal to the velocity of feed of the thread. This ensures that the thread tension remains constant even when the thread is not wound with crossed thread layers.

In accordance with the device of the invention for carrying out the foregoing method, there is provided an auxiliary thread guide located at each winding station of a textile machine, the auxiliary thread guide being adjustable at start-up of the winding method to an engageable position wherein a thread is guided thereby for winding on a coil and to a disengageable position wherein the thread is transferred by the auxiliary thread guide to a thread guide member, the auxiliary thread guide in the engageable position thereof being disposed so as to direct the thread to a location along the length of the coil at which the peripheral velocity of the coil is equal substantially to the velocity of feed of the thread.

In accordance with another feature of the device of the invention, the auxiliary thread guide is formed of a bracket having a saddle-like depression therein.

To allow a transfer of the thread to the thread guiding member only when the latter is travelling in the direction toward the smaller diameter end of the coil, in accordance with a further feature of the invention, the thread guide member is formed with a hook-shaped thread catch contour open in direction facing toward the smaller diameter end of the coil.

In order to start a winding station up, the position of the thread guiding member and of the thread storage device must be coordinated. Therefore, in accordance with an additional feature of the invention, the thread storage device is cooperatively connected with the auxiliary thread guide, the thread storage device being lockable in the zero position thereof.

It is further advantageous, in this regard, to couple the locking means with the disengagement means of the auxiliary thread guide. In accordance with another feature of the invention, consequently, mechanism is provided for adjusting the auxiliary thread guide to the disengageable position thereof, the thread storage device being lockable in zero position thereof by means coupled to the mechanism. Locking of the thread storage device can thus be neutralized and the auxiliary thread guide can be disengaged simultaneously by having it lock with the drive mechanism of the thread guiding member, when the thread guiding member is travelling in direction toward the smaller diameter end of the coil.

Further advantages derived from the invention are, in particular, that start-up of the winding device occurs with substantially constant thread tension and thread breaks due to excessive thread tension or uncontrolled thread movements are avoided.

Other features which are considered as characteristic for the invention are set forth in the appended claims.

Although the invention is illustrated and described herein as method and apparatus for winding conical cross-wound coils or bobbins with constant thread-feeding velocity, it is nevertheless not intended to be limited to the details shown, since various modifications may be made therein without departing from the spirit of the invention and within the scope and range of equivalents of the claims.

The invention, however, together with additional objects and advantages thereof will be best understood from the following description of the single FIGURE of the drawing which is a perspective view of apparatus for winding conical cross-wound bobbins with constant thread-feeding velocity according to the invention.

Referring now to the drawing, there is shown therein a winding station of a textile machine, having a supporting beam 11 with a base plate 12 fastened thereto. A winding roller 14 is secured on a shaft 13, which extends from winding station to winding station, the winding roller 14 having in the middle thereof, a zone 15 with a high coefficient of friction which ensures that a conical cross-wound coil 16, which rolls around on this zone 15 of the winding roller 14, will always be driven in the middle of the roller 14 and, accordingly, in the middle of the bobbin.

In special cases, the zone 15 having a high coefficient of friction can also be omitted. Because the drive zone is then no longer defined, changes in the slippage between the winding roller 14 and the bobbin 16 must be expected, which has an adverse effect on the desired uniform thread tension and also on the stress on the thread.

A centrally controlled thread-guiding member 18 is movable back and forth in the directions indicated by the double-headed arrow by means of a control rod 17, which extends from winding station to winding station. The thread-guiding member 18 has a hook-shaped thread-catching contour 19 which is open in direction toward the small diameter end of the bobbin and serves for receiving and simultaneously guiding the thread 20 that is to be wound.

The thread 20 is fed with preferably constant feeding velocity continuously upward from below, as shown in the figure, out of a non-illustrated feeding mechanism.

In a thread storage device 21, the thread 20 forms a loop 22 in that it is suitably deflected by a deflecting member 23 attached to the base plate 12, a movable deflecting member 24 secured to the end of a storage device lever 26 and a third deflecting member 25 which is also fastened to the base plate 12. The deflecting members 23, 24 and 25 are constructed as easily turning rollers with machined thread-guiding grooves.

The storage device lever 26, pivotable about a pin 27, has a zero position stop which is formed of a stop latch 29 pivotable about a pin 28, and a stop pin 30 secured to the stop latch 29, a stop arm 31 of the storage device lever 26 striking against the stop pin 30.

Since the stop latch 29 is held in position only through a coiled tension spring 32 so that it is drawn with a projection 33 thereof against a pin 34 secured to the base plate 12, the storage device lever 26 can be moved manually out of the zero position or neutral setting thereof and further to the left-hand side as viewed in the figure, after the spring force of the coiled tension spring 32 has been overcome, a feature that could be useful, for example, for inserting the thread 20 after a thread break.

The stop arm 31 of the storage device lever 26 is connected to an end of a tension spring 35, the other end of which is secured to the base plate 12. Under the biasing action of the spring 35, the storage device lever 26 is capable of drawing a thread loop of required length toward the right-hand side, as viewed in the figure. The spring force, in that case, acts advantageously on a lever arm that becomes increasingly longer with growing angular displacement of the storage device lever 26 about the pivot 27.

In the drawing, the thread storage device 21 and the thread guiding member 18 are shown in zero position or neutral setting thereof. In this position, a thread loop has already been formed, there is no stored supply of thread.

An engageable and disengageable auxiliary thread guide 36, formed of a wire bracket has an end 37 by which it is articulatingly connected to a control lever 38, which is pivotable about a pivot shaft 39. The control lever 38 has a handle 40, by means of which the auxiliary thread guide 36 can be engaged and disengaged. The drawing shows, in solid lines, the auxiliary thread guide 36 in disengaged position. In this disengaged position, the control lever 38 and the auxiliary thread guide 36, therewith, are locked by a locking latch 41, which is articulatingly secured to the ground plate 12 and has an angularly projecting end 43 which engages with the upper edge of the lever 38, as viewed in the figure, under the biasing action of a coil spring 42.

When placing the auxiliary thread guide 36 in engaged position as shown in phantom at 44, the locking latch 41 is drawn to the right-hand side of the figure and the handle 40 is raised until the control lever 38 has reached the position 45, shown in phantom. Because the angularly projecting end 43 of the locking latch 41, in the engaged position of the auxiliary thread guide 36, resiliently engages the vertical part of the control lever 38, as shown in the figure, the auxiliary thread guide 36 also is locked in the engaged position thereof.

For raising and lowering the auxiliary thread guide 36, the latter is provided with a parallel guidance system which is formed of a lever 46 pivotable about the pin 28, and a tie rod 47 articulatingly linked to the lever 46 and the control lever 38. The bracket end 53 of the auxiliarly thread guide 36 is articulatingly connected to the end of the lever 46.

In the engaged position of the auxiliary thread guide 36, shown in phantom in the drawing, the movement of the storage device level 26 is blocked. This is accomplished in the following manner. The control lever 38 carries a locking latch 49 which is pivotable about a pin 48 and engages a stop pin 51 under the biasing action of a coil torsion spring 50.

The moment the control lever 38 has reached the position 45 thereof shown in phantom, the locking latch 49 engages behind a stop pin 52 attached to the rear side of the storage device lever 26 and thus prevents the storage device lever 26 from swinging to the right-hand side of the figure. This locking of the storage device lever 26 can be neutralized manually by swinging the locking latch 49 downwardly against the biasing force of the coiled torsion spring 50.

When the auxiliary thread guide 36 is placed in the engaged position, the thread 20 slides out of the reciprocating thread guide member 18 and is directed toward the middle of the bobbin by the auxiliary thread guide 36, which is formed with a saddle-like depressed portion within the region of the thread guide 18. After this has occured, the thread is wound in the middle of the bobbin for as long as the auxiliary thread guide 36 is engaged. Because of the coordination of the feed of the thread and the speed of rotation of the bobbin, the thread feed velocity is equal to the winding velocity. No thread storage takes place. The thread tension is substantially constant.

When the auxiliary thread guide 36 is disengaged, the thread is re-transferred to the thread guiding member 18. Because of the thread catching contour 19, the transfer can occur only in the zero position or neutral setting of the thread guiding member 18. At the instant of thread transfer, the previously locked storage device lever 26 is unlocked, so that the winding process per se with crossed thread layers begins only then.

There is claimed:

1. Method of winding conical cross-wound coils at constant thread feed velocity wherein compensation is provided by a storage device for the varying winding speeds from the larger to the smaller diameters of the coils which comprises setting a thread storage device in zero position thereof, wherein no thread is being stored, after alternative occurrence of a coil change and a thread break; initially holding with an auxiliary thread guide a thread that is to be wound into a coil; advancing a thread guiding member in a direction from the larger toward the smaller diameter ends of the coil and, after releasing the thread from the auxiliary thread guide, taking over the thread with the thread guiding member.

2. Method according to claim 1 which comprises rotating the coil and wherein the thread is held by the auxiliary thread guide at a location along the length of the coil at which the peripheral velocity of the coil is substantially equal to the velocity of feed of the thread.

3. Device for carrying out the method of winding conical crosswound coils at constant thread feed velocity comprising an auxiliary thread guide located at each winding station of a textile machine, said auxiliary thread guide being adjustable at start-up of the winding method to an engageable position wherein a thread is guided thereby for winding on a coil and to a disengageable position wherein the thread is transferred by said auxiliary thread guide to a thread guide member, said auxiliary thread guide in said engageable position thereof being disposed so as to direct the thread to a location along the length of the coil at which the peripheral velocity of the coil is equal substantially to the velocity of feed of the thread.

4. Device according to claim 3 wherein said auxiliary thread guide is formed of a bracket having a saddle-like depression therein.

5. Device according to claim 3 wherein said thread guide member is formed with a hook-shaped thread catch contour open in direction facing toward the smaller diameter end of the coil.

6. Device according to claim 3 including a thread storage device cooperatively connected with said auxiliary thread guide, said thread storage device being lockable in zero position thereof.

7. Device according to claim 6 including mechanism for adjusting said auxiliary thread guide to said disengageable position, said thread storage device being lockable in zero position thereof by means coupled to said mechanism.

* * * * *